US011274521B2

(12) United States Patent
Jordan, Jr. et al.

(10) Patent No.: US 11,274,521 B2
(45) Date of Patent: Mar. 15, 2022

(54) DOWNHOLE VALVE AND METHOD OF USE

(71) Applicant: COLT PETROLEUM TECHNOLOGY, LLC, Little Rock, AR (US)

(72) Inventors: Henry Joe Jordan, Jr., Willis, TX (US); Barbara Jan Bailey, Little Rock, AR (US); Charles David Wintill, Houston, TX (US)

(73) Assignee: COLT PETROLEUM TECHNOLOGY, INC., Little Rock, AR (US)

( * ) Notice: Subject to any disclaimer, the term of this patent is extended or adjusted under 35 U.S.C. 154(b) by 0 days.

(21) Appl. No.: 16/985,813

(22) Filed: Aug. 5, 2020

(65) Prior Publication Data

US 2022/0042395 A1 Feb. 10, 2022

(51) Int. Cl.
*E21B 34/06* (2006.01)
*E21B 34/14* (2006.01)

(52) U.S. Cl.
CPC ..... *E21B 34/063* (2013.01); *E21B 34/14* (2013.01); *E21B 2200/02* (2020.05); *E21B 2200/06* (2020.05)

(58) Field of Classification Search
CPC .... E21B 34/063; E21B 34/14; E21B 2200/06; E21B 2200/02
See application file for complete search history.

(56) References Cited

U.S. PATENT DOCUMENTS 8,876,083 B2 * 11/2014 Black ..... F16K 3/26 251/344
10,184,318 B2 1/2019 Nichols
2012/0111574 A1 * 5/2012 Desranleau ..... E21B 34/14 166/373
2013/0284451 A1 * 10/2013 Merron ..... E21B 34/103 166/373
2015/0218916 A1 * 8/2015 Richards ..... E21B 43/04 166/278
2015/0369007 A1 * 12/2015 George ..... E21B 34/063 166/305.1
2019/0136666 A1 * 5/2019 Kent ..... E21B 43/14

* cited by examiner

*Primary Examiner* — Matthew Troutman
*Assistant Examiner* — Patrick F Lambe
(74) *Attorney, Agent, or Firm* — Patterson + Sheridan, LLP

(57) ABSTRACT

In an embodiment is provided a valve that includes a housing, a mandrel connected to the housing and defining an interior volume therebetween, a sleeve having a first end and a second end, the sleeve movably disposed in the interior volume, a chamber defined in the interior volume, the chamber having a first end and a second end, an inlet of a metering device coupled to the second end of the chamber, and an outlet of the metering device adjacent to the first end of the sleeve. In another embodiment is provided a method of using a valve that includes introducing pressure to a central bore of the valve such that a sleeve of the valve moves from a closed, locked position to a test position. The closed, locked position and the test position do not permit fluid communication between a central bore and an exterior of the valve.

20 Claims, 3 Drawing Sheets

CLOSED, LOCKED POSITION

CLOSED, UNLOCKED POSITION

OPEN, LOCKED POSITION

DOWNHOLE VALVE AND METHOD OF USE

FIELD

Embodiments of the present disclosure generally relate to drilling and the related equipment used in, e.g., the oil and gas industry. More specifically, embodiments of the present disclosure relate to valves, e.g., downhole valves, and to their methods of use.

BACKGROUND

Valves, such as downhole valves, find applications in at least the oil and gas industry. The valves are useful for permitting flow of fluids, e.g., hydrocarbons, between interior portions of the valve and external portions of the valve. Conventional valves lack the capability of providing a time period after pressurizing the valve to examine the valve and other equipment. Typically, after pressurizing the valve, the valve will lock in an open position before the valve and other equipment at the rig site can be checked for desired operability. Once locked, the valve cannot close. If the equipment is not operating as desired, the operation must be restarted—including removing the valve from the site by tripping the pipe and installing a new valve and running the pipe back into the well.

There is a need for improved valves and methods of use that overcome one or more deficiencies of conventional valves and methods of use.

SUMMARY

Embodiments of the present disclosure generally relate to drilling and the related equipment used in, e.g., the oil and gas industry. More specifically, embodiments of the present disclosure relate to valves, e.g., downhole valves, and to their methods of use.

In an embodiment is provided a valve that includes a housing, a mandrel connected to the housing and defining an interior volume therebetween, a sleeve having a first end and a second end, the sleeve movably disposed in the interior volume, a chamber defined in the interior volume, the chamber having a first end and a second end, an inlet of a metering device coupled to the second end of the chamber, and an outlet of the metering device adjacent to the first end of the sleeve.

In another embodiment is provided a valve that includes a housing, a mandrel connected to the housing and defining an interior volume therebetween, a sleeve having a first end and a second end, the sleeve movably disposed in the interior volume, a chamber defined in the interior volume, the chamber having a first end and a second end, a chamber fluid disposed in the chamber, a piston coupled to the first end of the chamber, the piston configured to exert force on the chamber fluid, an inlet of a metering device coupled to the second end of the chamber, and an outlet of the metering device adjacent to the first end of the sleeve.

In another embodiment is provided a method of using a valve described herein that includes introducing pressure to a central bore of the valve such that a sleeve of the valve moves from a closed, locked position to a test position. The closed, locked position does not permit fluid communication between a central bore and an exterior of the valve, and the test position does not permit fluid communication between the central bore and the exterior of the valve.

BRIEF DESCRIPTION OF THE DRAWINGS

So that the manner in which the above recited features of the present disclosure can be understood in detail, a more particular description of the disclosure, briefly summarized above, may be had by reference to aspects, some of which are illustrated in the appended drawings. It is to be noted, however, that the appended drawings illustrate only exemplary aspects and are therefore not to be considered limiting of its scope, for the disclosure may admit to other equally effective aspects.

To facilitate understanding, identical reference numerals have been used, where possible, to designate identical elements that are common to the figures. It is contemplated that elements and features of one example may be beneficially incorporated in other examples without further recitation.

DETAILED DESCRIPTION

Embodiments of the present disclosure generally relate to drilling and related equipment used in, e.g., the oil and gas industry. More specifically, embodiments of the present disclosure relate to valves, e.g., downhole valves, and to their methods of use. These downhole valves can be installed within a casing or a tubing string. These valves may be used in applications where hydrostatic pressure can be used to open a valve.

The valves described herein provide flow ports between the internal and external portions that are selectively isolated until a successful integrity test of the casing or tubing string is completed. Hydrostatic pressure applied to the internal portion of the tool causes movement of an internal piston which pushes a fluid, e.g., a hydraulic fluid, into a metering device (e.g., a tortuous path). After exiting the metering device, the fluid then exerts hydrostatic pressure on a sleeve of the valve until a limit is reached which permanently opens the valve.

The downhole valves described herein provide a time period between pressurizing the interior of the casing or tubing string and setting (or locking) the valve in an open position. For example, a pressure integrity test can commence by pressurizing the casing or tubing string. The pressure can be held for a period of time before the valve opens. During this time period, a user can examine the valve and other tools at the rig site to ensure that they are operating as desired. If for any reason the test is desired to be terminated, the valve may be returned to its original configuration. In contrast, once conventional casings or tubing strings are pressurized (e.g., pressurized in the interior diameter of central bore 122), the valves will lock before the tools can be checked for desired operability. If the tools are not operating as desired, the operation must be restarted, including tripping pipe and re-running pipe back into the well, all of which is very time consuming. Thus, the valves of the present disclosure can enable lower costs for drilling.

As discovered by the inventors, the improved valve design described herein includes a fluid and a metering device through which the fluid flows. The amount of time where the pressure is held before the valve opens and locks can be advantageously determined by, at least, characteristics of the fluid (e.g., viscosity) as well as the length and/or complexity of the metering device (e.g., a tortuous path).

Figure 1:
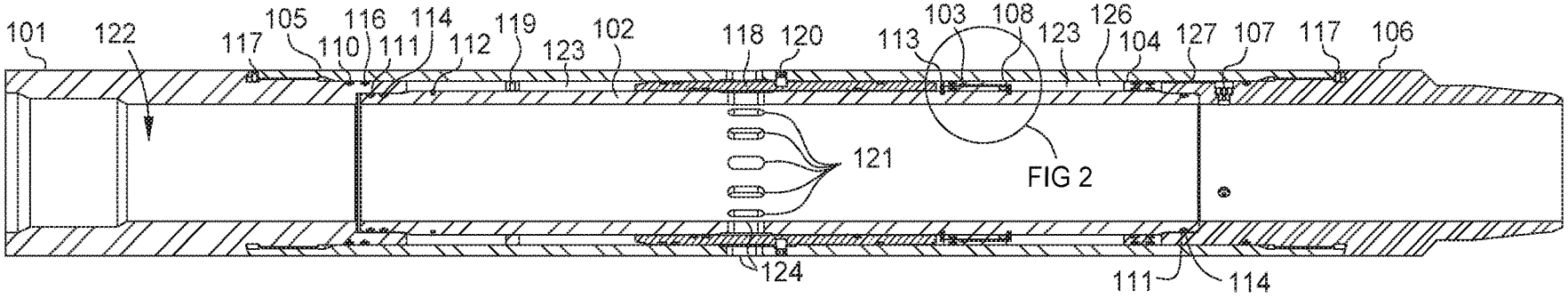
FIG. 1 is a cross sectional view of an example valve according to at least one embodiment of the present disclosure.

Embodiments of the present disclosure generally relate to valves. FIG. 1 is a cross sectional view of an exemplary valve 100 according to at least one embodiment of the present disclosure. The exemplary valve 100 includes a housing 105 that defines an outside diameter of the exemplary valve 100. The exemplary valve 100 also includes a mandrel 102 that defines an inner diameter of the passage that goes through it. An interior volume 123 is defined between the inner diameter of the housing 105 and the outside diameter of the mandrel 102. A sleeve 118 is slidably disposed in the interior volume 123 formed between the inner diameter of the housing 105 and the outside diameter of the mandrel 102. The sleeve includes seals, e.g., o-rings and back-up rings, on the inside diameter and outside diameter thereof prevent fluids from moving across its surface. In some embodiments, sleeve 118 can be made of a composite material that can advantageously dissolve in the presence of, e.g., a desired fluid and/or pressure.

The mandrel 102 is trapped between the top sub 101 and the bottom sub 106. One or more o-rings 114 and one or more back-up rings 111 can be located on the outside diameter of the mandrel 102. The housing 105 is threadedly coupled to the top sub 101 and to the bottom sub 106. One or more o-rings 116 and one or more back-up rings 110 can be located on the inside diameter of the housing 105. Back-up rings 110, 111 and o-rings 114, 116 serve to prevent wellbore fluid (or tubing fluid) from entering interior volume 123. Screws 117, e.g., knurled-cup point set screws, are used to lock the housing in place once threaded onto the top and bottom subs. The mandrel 102 defines a central bore 122 for the transmission of fluids. The central bore 122, as shown in this application, includes one or more flow ports 121 through which fluids can flow once the sleeve 118 is moved within the interior volume 123. Both the mandrel 102 and the housing 105 include ports 124 that allow selective communication between the central bore 122 and the exterior of the valve. Flow ports 121 and ports 124 can be circular, slotted, or of any shape to provide adequate flow area.

The exemplary valve 100 further includes one or more rupture discs 107. The one or more rupture discs 107 is disposed in a port. The one or more rupture discs are located in the bottom sub 106 between the central bore 122 and a channel 127 formed between the bottom sub 106 and the inner diameter of the housing 105. The channel 127 is in fluid communication with the interior volume 123. The outside diameter of the bottom sub 106 can be finned, e.g., have a smaller outside diameter than the threaded portion adjacent to screws 117 to create an annulus. When the rupture disc 107 ruptures, wellbore fluid (or tubing fluid) from the interior of central bore 122 flows through the port and into the channel 127.

A piston 104 is slidably disposed in the interior volume 123. The piston 104 includes seals, e.g., o-rings and back-up rings, on the inside diameter and outside diameter thereof to prevent fluids from moving across its surface. During operation, wellbore fluid (or tubing fluid) can flow from the central bore 122 and into the channel 127 through the one or more rupture discs 107 once the set pressure for rupturing the discs has been achieved. In some embodiments, seals can be placed on the pistons such that the wellbore fluid (or tubing fluid) does not leak around the piston. The one or more rupture discs 107 can be application specific, rupturing at desired pressures based on, e.g., a pressure below the test pressure. For example, if the pressure on the tube is 20,000 psi, the rupture disc can be selected to rupture at 17,000 psi (or about 85% of the test pressure).

Piston 104, external ring 113*a*, and a portion of interior volume 123 create a volume of a chamber 126. A chamber fluid, such as a hydraulic fluid, e.g., a gear oil, is disposed within the volume of chamber 126. The chamber fluid does not need to be under pressure. A viscosity of the chamber fluid is selected to define a time delay in combination with a metering device defined for the fluid to flow through. The metering device 125 (e.g., a tortuous path) is defined by metering device inner ring 103 and metering device outer ring 108. Grooving or threads are disposed on the outside diameter face of metering device inner ring 103 and in the inside diameter face of metering device outer ring 108. The grooves or threads when mated define a metering device 125 through which fluid in interior volume 123 can flow under pressure created by the piston 104.

Figure 2:
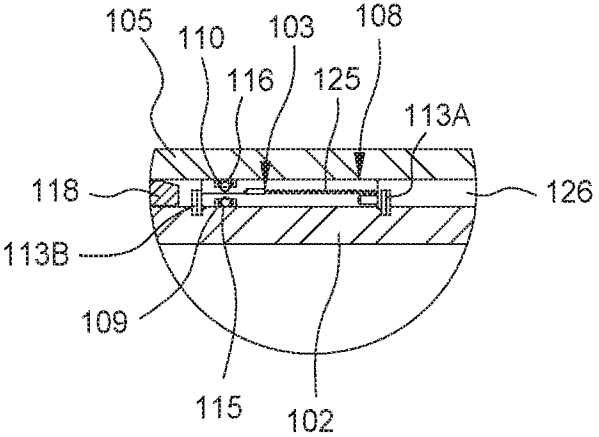
FIG. 2 is a detailed cross sectional view of a portion of FIG. 1 according to at least one embodiment of the present disclosure.

FIG. 2 is a detailed cross sectional view showing the metering device 125 among other components. The metering device 125 (e.g., a tortuous path) is a restricted pathway through which the chamber fluid traverses. The metering device 125 can be a threaded path. In at least one embodiment, a bottom of the metering device 125 can be defined by metering device outer ring 108 and a top of the metering device 125 is defined by metering device inner ring 103. External rings 113*a*, 113*b* can be individually disposed both sides of the metering device inner ring 103 and metering device outer ring 108 to secure the metering device inner ring 103 and metering device outer ring 108 in place. The external rings 113*a*, 113*b* serve to isolate the metering device 125. The external rings 113*a*, 113*b* also prevent metering device 125 from moving. One or more back-up rings 109 and one or more o-rings 115 can be disposed on the outside diameter of the mandrel 102 and located between metering device inner ring 103 and external ring 113*b*. One or more back-up rings 110 and one or more o-rings 116 can be disposed on the inside diameter of the housing 105 and located between metering device inner ring 103 and external ring 113*b*. Back-up rings 109, 110 and o-rings 115, 116 serve to prevent the chamber fluid from bypassing the metering device 125.

Referring again to FIG. 1, a plurality of shear screws 120 can be located in the housing 105 and can be coupled to sleeve 118 to secure the sleeve in its initial valve closing position. As a non-limiting example, the plurality of shear screws 120 can have tolerances of about 5,000 psi to about 7,000 psi. A support ring 119 can be disposed in a portion of the interior volume. The support ring 119 can be used to support and maintain the spacing within the interior volume and minimize the amount of deflection between components of the tool, e.g., the housing 105 and the mandrel 102. A locking apparatus, such as one or more lock-snap rings 112, located in a groove formed in the mandrel 102 and extend into the interior volume 123. The lock-snap rings 112 lock and/or friction grip the sleeve 118 when the sleeve moves to the valve open position.

Embodiments of the present disclosure also relate to methods of using a valve. Generally, the exemplary valve 100 can include flow ports 121 and ports 124 between internal and external portions of the exemplary valve 100. The internal and external portions of the exemplary valve 100 are selectively isolated until, e.g., an integrity test of the casing and/or tubing string is completed. After a successful integrity test is achieved, fluid can transfer from the interior to the exterior via flow ports 121 and ports 124 once the valve is opened.

Figure 3A:
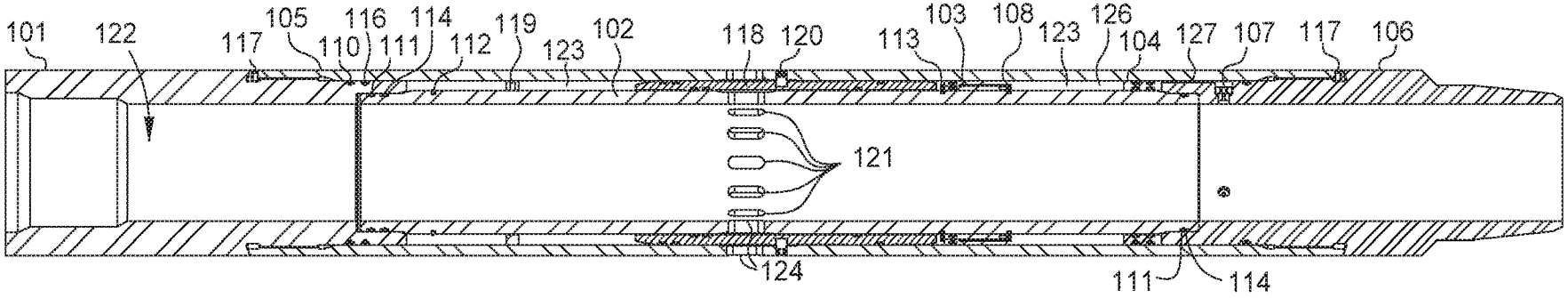
FIG. 3A is a cross sectional view of an example valve in a closed, locked position according to at least one embodiment of the present disclosure.
Figure 3B:
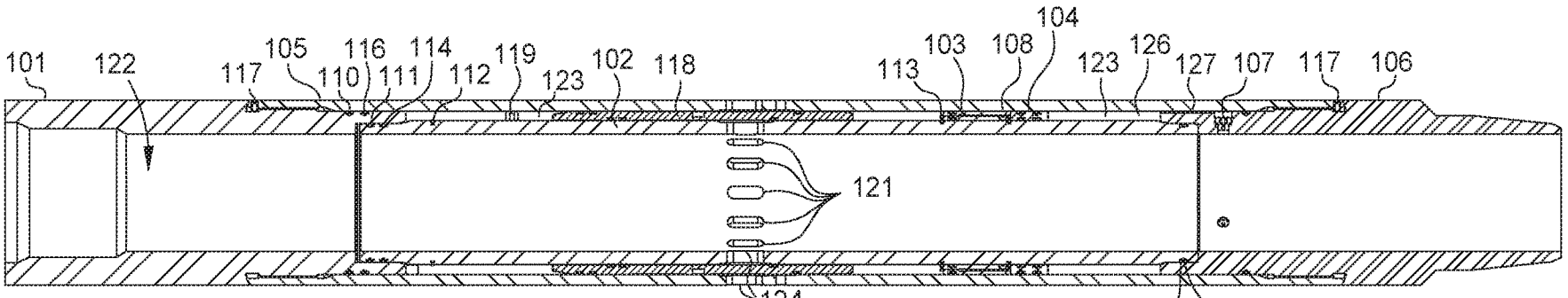
FIG. 3B is a cross sectional view of an example valve in a closed, unlocked position according to at least one embodiment of the present disclosure.
Figure 3C:
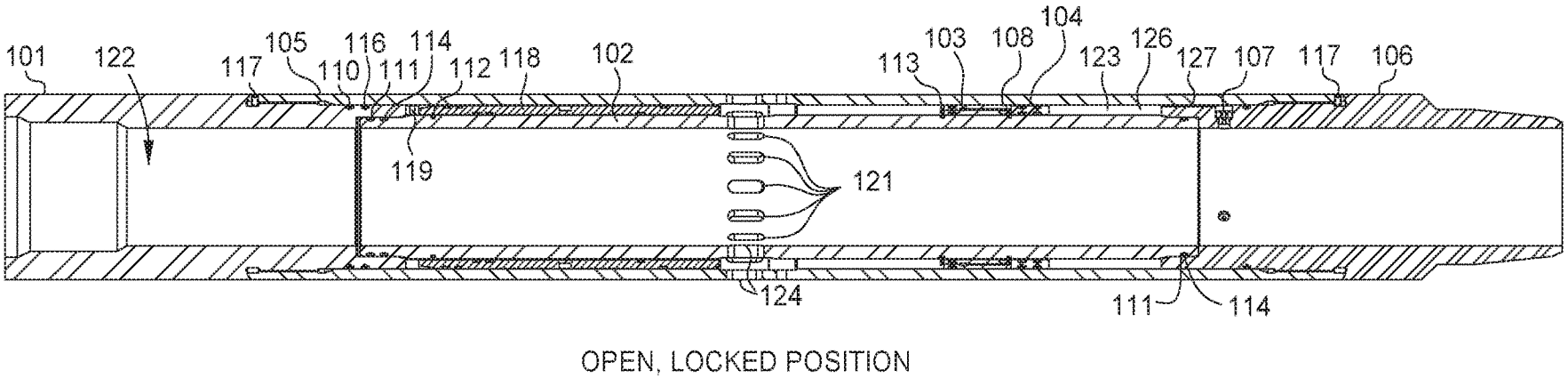
FIG. 3C is a cross sectional view of an example valve in an open, locked position according to at least one embodiment of the present disclosure.

FIGS. 3A-3C are cross sectional views of an exemplary valve 100 in various states of operation according to at least one embodiment of the present disclosure. The various states of operation can include a closed, locked position (FIG. 3A), a closed, unlocked position (FIG. 3B), and an open, locked position (FIG. 3C). The sleeve 118 is slidably movable between at least these positions under fluid pressure. The sleeve 118 has a travel path between, at least, the following positions: the closed, locked position; the closed, unlocked position; and the open, locked position. The sleeve 118 can be slidably movable in either direction between the closed, locked position, and the closed, unlocked position. The closed, unlocked position can be referred to as a test position where, e.g., a test pressure is held for a period of time before the valve opens and during which the valve and/or other tools can be checked to ensure desired operability. In some embodiments, and as non-limiting examples, this period of time can be at least about 30 minutes or more, such as from about 30 minutes to about 120 minutes.

The direction of movement of the sleeve 118 is determined by, at least, a pressure differential between a first end and second end of the sleeve 118. The amount of time between the various positions shown in FIGS. 3A-3C can be regulated by, at least, the dimensions and characteristics of the metering device and the viscosity of the chamber fluid. As a non-limiting example, the viscosity of the chamber fluid can be greater than about 50 cP, such as about 150 cP or more, such as about 300 cP or more, such as about 380 cP or more. Selection of the chamber fluid can be based on, at least, its viscosity.

In use, the exemplary valve 100 can be assembled and the chamber fluid (e.g., gear oil) can be loaded into the volume of chamber 126. The chamber fluid can be loaded into the volume of chamber 126 off-site or on-site. The exemplary valve 100 can then be run into the well.

FIG. 3A shows the exemplary valve 100 in a closed, locked position. At this position, fluid communication is not permitted between the central bore 122 and an exterior of the exemplary valve 100. That is, sleeve 118 is positioned to prevent fluid from flowing between the internal and external portions of the exemplary valve 100. If it is desired to open the exemplary valve 100, and while the pressure is still being applied, the rupture disc 107 can rupture and the wellbore fluid (or tubing fluid) from the interior of the central bore 122 can enter the channel 127 through the port in which the rupture disc 107 is disposed. Wellbore fluid (or tubing fluid) can then exert a force against the piston 104. The piston 104, in turn, can exert force on the chamber fluid located in chamber 126. The chamber fluid will then enter the metering device 125. The chamber fluid, which can be a high viscosity fluid, can traverse the metering device 125 and can exit the metering device 125 via metering device inner ring 103. As the pressure builds on one end of the sleeve 118, the shear screws 120 shear on reaching the threshold pressure and the sleeve 118 can begin to traverse away from bottom sub 106 and towards support ring 119.

FIG. 3B shows the valve in a closed, unlocked position where the chamber fluid has exerted pressure on the sleeve 118 and the shear screws 120 have sheared. In this closed, unlocked position, the sleeve 118 remains positioned between the flow ports 121 and ports 124, but the sleeve 118 has traversed away from bottom sub 106 and towards support ring 119.

FIG. 3C shows the valve in an open, locked position. In the open, locked position, sleeve 118 has traversed away from the bottom sub 106 and pushed support ring 119 to a position near or coupled to top sub 101. In addition, the lock-snap ring 112 has locked and/or friction gripped the sleeve 118, securing the sleeve 118 in the open, locked position. In the open, locked position, fluid communication is permitted, e.g., permanently permitted, between the central bore 122 and an exterior of the exemplary valve 100. That is, sleeve 118 no longer restricts fluid from flowing between the internal and external portions of the exemplary valve 100 via flow ports 121 and ports 124.

To perform a pressure integrity test, the pressure on the interior of the casing or tubing string can be raised to an identified target that is typically below that of the valve setting pressure. This pressure may be held for a period of time before the valve opens and traverses to the locked position. For example, if the user loads a test pressure on the tube of 20,000 psi, the rupture disc can rupture at 17,000 psi (or about 85% of the test pressure). At this stage, the rupture disc 107 ruptures and the sleeve 118 begins to move. If the sleeve 118 is not fully locked in the open, locked position, the user can lower the pressure on the interior of the casing or tubing string if the test is desired to be terminated, returning the valve to its original configuration of FIG. 3A. As described above, this pressure can be held for a period of time to enable the user to check the exemplary valve 100 and other tools to ensure that the exemplary valve 100 and other tools are operating as desired. Therefore, testing can be performed multiple times if desired.

For purposes of this disclosure, and unless otherwise specified, all numerical values within the detailed description and the claims herein are modified by "about" or "approximately" the indicated value, and consider experimental error and variations that would be expected by a person having ordinary skill in the art.

As used herein, the indefinite article "a" or "an" shall mean "at least one" unless specified to the contrary or the context clearly indicates otherwise. For example, embodiments comprising "an o-ring" include embodiments comprising one, two, or more o-rings, unless specified to the contrary or the context clearly indicates only one o-ring is included.

All documents described herein are incorporated by reference herein, including any priority documents and/or testing procedures to the extent they are not inconsistent with this text. Further, all documents and references cited herein, including testing procedures, publications, patents, journal articles, etc. are herein fully incorporated by reference for all jurisdictions in which such incorporation is permitted and to the extent such disclosure is consistent with the description of the present disclosure. As is apparent from the foregoing general description and the specific aspects, while forms of the aspects have been illustrated and described, various modifications can be made without departing from the spirit and scope of the present disclosure. Accordingly, it is not intended that the present disclosure be limited thereby. Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of" "consisting of" "selected from the group of consisting of" or "Is" preceding the recitation of the composition, element, or elements and vice versa, e.g., the terms "comprising," "consisting essentially of," "consisting of" also include the product of the combinations of elements listed after the term.

While the foregoing is directed to embodiments of the present disclosure, other and further embodiments of the disclosure may be devised without departing from the basic scope thereof, and the scope thereof is determined by the claims that follow.

What is claimed is:

1. A valve, comprising:

a housing;

a mandrel connected to the housing and defining an interior volume therebetween;

a sleeve having a first end and a second end, the sleeve movably disposed in the interior volume;

a channel in fluid communication with the interior volume;

a rupture disc in fluid communication with the channel, the rupture disc configured to rupture and permit flow of a wellbore fluid from a central bore of the housing into the channel;

a chamber defined in the interior volume, the chamber having a first end and a second end;

a chamber fluid disposed in the chamber, the chamber fluid configured to exert a pressure on the sleeve;

a piston in fluid communication with the channel and the chamber, the piston configured to exert force on the chamber fluid upon contact of the wellbore fluid with the piston; and a metering device having:

an inlet, the inlet of the metering device coupled to the second end of the chamber;

an outlet, the outlet of the metering device adjacent to the first end of the sleeve and a path through which the chamber fluid flows under the force exerted by the piston, the path of the metering device being defined by mating first grooves or threads disposed on an outside diameter face of a metering device inner ring with second grooves or threads disposed on an inside diameter face of a metering device outer ring.

2. The valve of claim 1, further comprising a shear screw securing the sleeve when the valve is in a closed, locked position, the shear screw configured to shear when the pressure exerted by the chamber fluid on the sleeve reaches a threshold pressure.

3. The valve of claim 2, wherein the first end of the chamber is coupled to the piston.

4. The valve of claim 3, wherein:

the channel has a first end and a second end, the piston coupled to the second end of the channel; and the rupture disc is coupled to the first end of the channel.

5. The valve of claim 1, further comprising a locking apparatus configured to secure the sleeve in an open, locked position.

6. The valve of claim 5, wherein the locking apparatus is coupled to the second end of the sleeve when the sleeve is in an open, locked position.

7. The valve of claim 1, wherein the sleeve is selectively moveable between a closed, locked position and an open, unlocked position.

8. The valve of claim 1, wherein the sleeve is moveable between:

a closed, locked position wherein fluid communication is not permitted between the central bore and an exterior of the valve;

a test position wherein fluid communication is not permitted between the central bore and the exterior of the valve; and an open, locked position wherein fluid communication is permanently permitted between the central bore and the exterior of the valve.

9. The valve of claim 1, wherein the sleeve has a travel path between a closed, locked position, an open, locked position, and a test position between the closed, locked position and the open, locked position.

10. The valve of claim 9, wherein the sleeve is movable in either direction between the closed, locked position and the test position.

11. A valve, comprising:

a housing;

a mandrel connected to the housing and defining an interior volume therebetween;

a sleeve having a first end and a second end, the sleeve movably disposed in the interior volume;

a chamber defined in the interior volume, the chamber having a first end and a second end;

a chamber fluid disposed in the chamber, the chamber fluid configured to exert a pressure on the sleeve;

a piston coupled to the first end of the chamber, the piston configured to exert force on the chamber fluid upon contact of a wellbore fluid with the piston; and a metering device having:

an inlet, the inlet of the metering device coupled to the second end of the chamber;

an outlet, the outlet of the metering device adjacent to the first end of the sleeve, and a path through which the chamber fluid flows under the force exerted by the piston, the path of the metering device being defined by mating first grooves or threads disposed on an outside diameter face of a metering device inner ring with second grooves or threads disposed on an inside diameter face of a metering device outer ring.

12. The valve of claim 11, further comprising:

a channel having a first end and a second end, the first end of the channel in fluid communication with the interior volume, the piston coupled to the second end of the channel;

a rupture disc coupled to the first end of the channel, the rupture disc configured to rupture and permit flow of the wellbore fluid from a central bore of the housing and into the channel; and a locking apparatus configured to secure the sleeve in an open, locked position.

13. The valve of claim 11, wherein the sleeve is moveable between:

a closed, locked position wherein fluid communication is not permitted between a central bore of the housing and an exterior of the valve;

a test position wherein fluid communication is not permitted between the central bore and the exterior of the valve; and an open, locked position wherein fluid communication is permanently permitted between the central bore and the exterior of the valve.

14. The valve of claim 11, wherein:

the sleeve has a travel path between a closed, locked position, an open, locked position, and a test position between the closed, locked position and the open, locked position;

the sleeve is movable in either direction between the closed, locked position and the test position; or a combination thereof.

15. A method of using a valve, comprising:

introducing pressure to a central bore of the valve such that a sleeve of the valve moves from a closed, locked position to a test position, the valve comprising:

a housing;

a mandrel connected to the housing and defining an interior volume therebetween;

the sleeve, the sleeve having a first end and a second end, the sleeve movably disposed in the interior volume;

a channel in fluid communication with the interior volume;

a rupture disc in fluid communication with the channel, the rupture disc configured to rupture and permit flow of a wellbore fluid from the central bore of the housing and into the channel;

a chamber defined in the interior volume, the chamber having a first end and a second end;

a chamber fluid disposed in the chamber, the chamber fluid configured to exert a hydrostatic pressure on the sleeve;

a piston in fluid communication with the channel and the chamber, the piston configured to exert force on the chamber fluid upon contact of the wellbore fluid with the piston; and a metering device having:

an inlet, the inlet of the metering device coupled to the second end of the chamber;

an outlet, the outlet of the metering device adjacent to the first end of the sleeve; and a path through which the chamber fluid flows under the force exerted by the piston, the path of the metering device is defined by mating first grooves or threads disposed on an outside diameter face of a metering device inner ring with second grooves or threads disposed on an inside diameter face of a metering device outer ring, wherein the closed, locked position does not permit fluid communication between the central bore and an exterior of the valve, and wherein the test position does not permit fluid communication between the central bore and the exterior of the valve.

16. The method of claim 15, wherein the first end of the chamber is coupled to the piston.

17. The method of claim 16 wherein:

the channel has a first end and a second end, the piston coupled to the second end of the channel; and the rupture disc is coupled to the first end of the channel.

18. The method of claim 15, wherein the sleeve is moveable between:

the closed, locked position;

the test position; and an open, locked position wherein fluid communication is permanently permitted between the central bore and the exterior of the valve.

19. The method of claim 15, further comprising relieving the pressure on the central bore of the valve such that the sleeve moves to the closed, locked position.

20. The method of claim 15, further comprising maintaining the pressure on the central bore of the valve such that the sleeve moves to an open, locked position, wherein fluid communication is permanently permitted between the central bore and the exterior of the valve.

* * * * *